US005275393A

United States Patent [19]

Cromie

[11] Patent Number: 5,275,393

[45] Date of Patent: Jan. 4, 1994

[54] AIR INJECTION DEVICE

[75] Inventor: John F. Cromie, Rushden, England

[73] Assignee: Xerox Corporation, Stamford, Conn.

[21] Appl. No.: 14,595

[22] Filed: Feb. 8, 1993

[30] Foreign Application Priority Data

Mar. 2, 1992 [GB] United Kingdom ..... 92-04513

[51] Int. Cl.[5] ..... B65H 3/14

[52] U.S. Cl. ..... 271/98; 138/45; 271/108

[58] Field of Search ..... 271/96, 97, 98, 108, 271/212; 138/45; 251/61, 1, 7

[56] References Cited

U.S. PATENT DOCUMENTS

| | | | |
|---|---|---|---|
| 1,950,774 | 3/1934 | Biggs | 138/45 |
| 3,513,881 | 5/1970 | Kinsell | 138/45 |
| 4,299,381 | 11/1981 | Smith | 271/96 |
| 4,451,028 | 5/1984 | Holmes et al. | 271/11 |
| 4,550,903 | 11/1985 | Moore | 271/98 |
| 4,566,683 | 1/1986 | Moore | 271/98 |
| 4,596,385 | 6/1986 | Silverberg | 271/94 |
| 4,699,369 | 10/1987 | Zirilli | 271/94 |

FOREIGN PATENT DOCUMENTS

| | | | |
|---|---|---|---|
| 587263 | 4/1925 | France | 138/45 |

OTHER PUBLICATIONS

Wenthe, Stack Weight Sensing Paper Tray, Xerox Disclosure Journal, vol. 7, No. 4, Jul./Aug. 1982, p. 229.

*Primary Examiner*—N. Grant Skaggs

[57] ABSTRACT

An air injection device including a housing defining an air duct therein and a valve associated with the air duct for controlling the flow of air therethrough from a pressure source (55). The valve has a sheet (59) of flexible material positioned within the air duct, the sheet (59) being mounted on a face (60) of the air duct with the ends of the sheet (59) restricted from moving in a direction substantially orthogonal to the face (60) but free to move in a direction parallel to the face (60). The sheet (59) is operably connected to control, such as a solenoid valve (62), for controlling the contour of the sheet (59), within an air flow passing through the air duct. In one embodiment a second sheet is positioned on the inside top face of the duct opposite the first sheet (59). The air injection device is particularly useful for application with a sheet separator-feeder.

11 Claims, 4 Drawing Sheets

AIR INJECTION DEVICE

Figure 1:
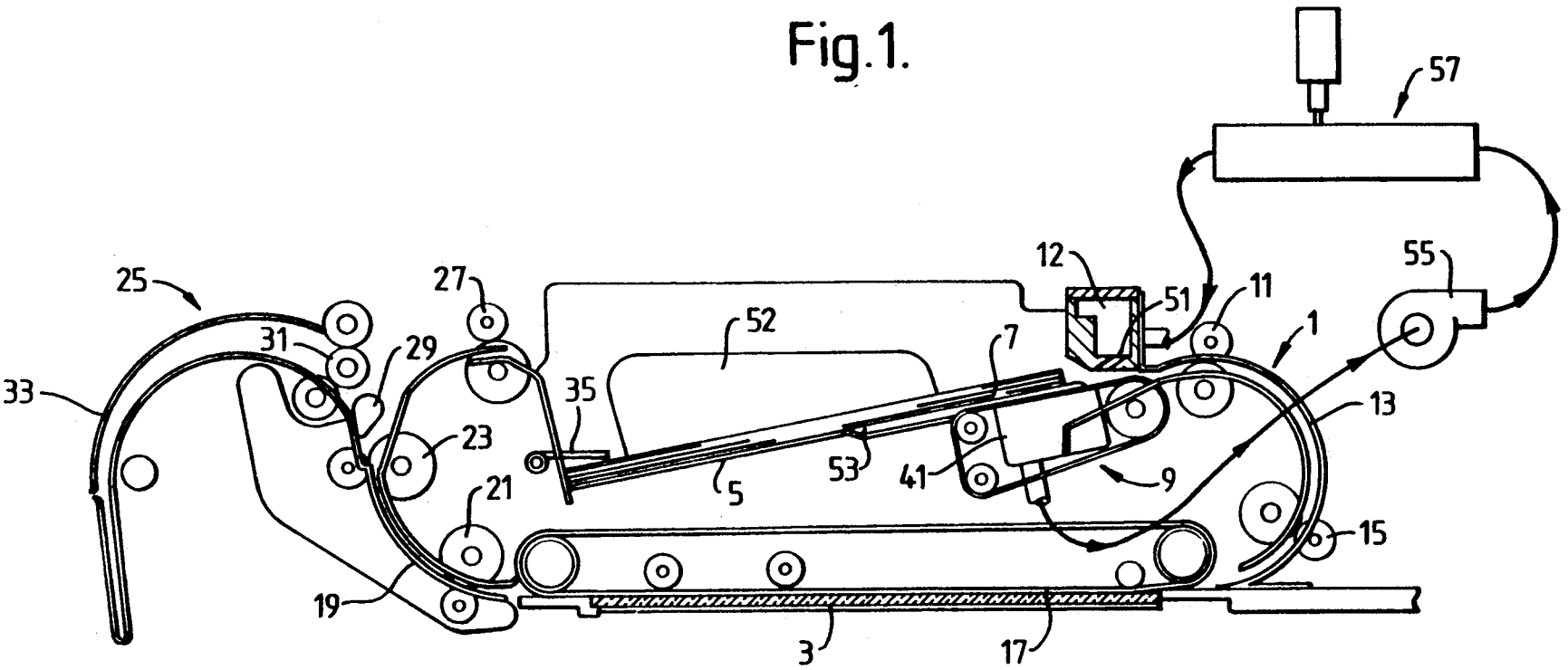

The present invention relates to an air injection device and more particularly, but not exclusively, to an air knife for sheet separator-feeders which separate and forward sheets seriatim from a stack of the sheets. The invention is particularly concerned with air knives for separator-feeders which use vacuum means for performing the separating and forwarding functions.

Some bottom sheet separator-feeders for separating and forwarding sheets seriatim from a bottom of the stack of sheets to be fed, include a stack tray defining a surface for supporting a stack of sheets to be fed, the tray having a depressed central portion forming a pocket in at least the front part of the surface, vacuum feed means disposed in the pocket so as to pull the bottom sheet in the stack into the pocket and feed the sheet from beneath the stack, and air injection means, in the form of an air knife, disposed adjacent the front of the tray to inject air between the bottom sheet in the stack and the tray and between the bottom sheet and the remainder of sheets in the stack. In operation the sheets sag into the depressed central portion and the presence of a little nib feature formed on the surface of the tray in the middle of the depressed portion creates a small gap between the bottom sheet and the next to bottom sheet into which air from the air knife gets access and facilitates separation.

While feed mechanisms have been designed that are self-compensating for various paper thicknesses or stiffness, where the document handler will be used with a large variation in the size of the document stack placed therein, a problem may be encountered in providing the correct air flow from the air knife. With a very small stack of documents, excessive air flow could cause excessive document flutter or in the extreme actually blow documents out of the document tray. With a large stack of documents, insufficient air would not produce the required air bearing or separation between the sheets, resulting in the possibility of misfeeds or multifeeds.

Feed mechanisms are known in which the air flow from the air knife is varied in relation to the size of the stack of sheets placed in the stack tray. In one conventional bottom vacuum feeder a valve in conjunction with the air knife is utilized to vary the air flow from the air knife, the valve being a rotatable plate which is rotated into various positions by way of the use of solenoids and the appropriate linkage. In another known feeder the air flow is controlled by one or more rotary valves in the form of a concentric cylinder having at least two different sized openings formed in its wall. The cylinder or cylinders are used as sleeve valve elements and are arranged to be actuated into various air flow restrictions by respective solenoids. One of the disadvantages of these arrangements is the noise generated by the air knife when it is in operation. The noise is a result of air turbulence caused by the sudden change in cross-section as the air flow passes out from the valve into an air duct associated with the air knife.

It is an object of the present invention to provide a simple and economical mechanism within the air duct associated with the air knife which enables control of air flow through the air duct without inducing excessive turbulence and noise.

Accordingly, the present invention provides an air injection device comprising a housing defining an air duct therein and valve means associated with said air duct for controlling the flow of air therethrough from a pressure source means, characterized in that said valve means comprises a sheet of flexible material positioned within the air duct, said sheet being mounted on a face of the air duct with the ends of the sheet restricted from moving in a direction substantially orthogonal to the face but free to move in a direction parallel to the face, said sheet being operably connected to control means for controlling the contour of the sheet within an air flow passing through the air duct.

The present invention also provides a sheet separator-feeder for separating and forwarding sheets seriatim, including a stack tray adapted for supporting a stack of sheets, an air injection means adapted to provide a layer of air between the sheet to be fed and the remainder of the stack, a pressure source associated with said air injection means for providing positive air pressure to said air injection means and valve means associated with said air injection means being adapted to control the flow of air thereto from said source means, characterized in that said valve means comprises a sheet of flexible material positioned within an air duct of said air injection means, said sheet being mounted on a face of the air duct with the ends of the sheet restricted from moving in a direction substantially orthogonal to the face but free to move in a direction parallel to the face, said sheet being operably connected to control means for controlling the contour of the sheet within an air flow passing through the air duct.

In one embodiment, restricting means in the form of a plurality of projections restrict the ends of a sheet from moving in a direction substantially orthogonal to the face, the projections defining spaces with the face to accommodate the end portions of the sheet. In a preferred embodiment the projections are molded to the walls of the air duct.

In one embodiment the sheet, such as a polyester based film, is positioned on the inside bottom face of the duct. In a further embodiment, a second sheet is positioned on the inside top face of the duct opposite the first sheet. Conveniently, the or each sheet is operably connected to a respective solenoid selectively operable for moving the sheet between a pair of positions. Alternatively, the or each sheet is operably connected to a respective cam arrangement selectively operable to move the sheet into one or more of a multiplicity of positions thereby providing a multiplicity of levels of flow through the air duct.

Figure 2:
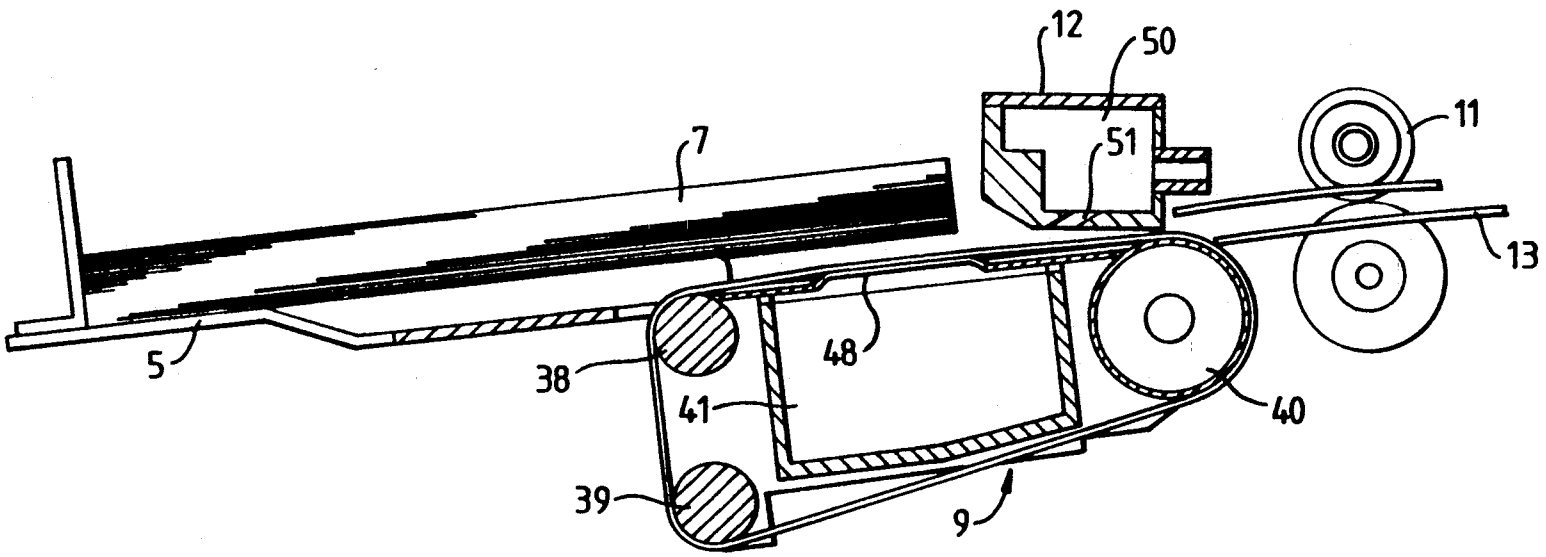
Figure 3:
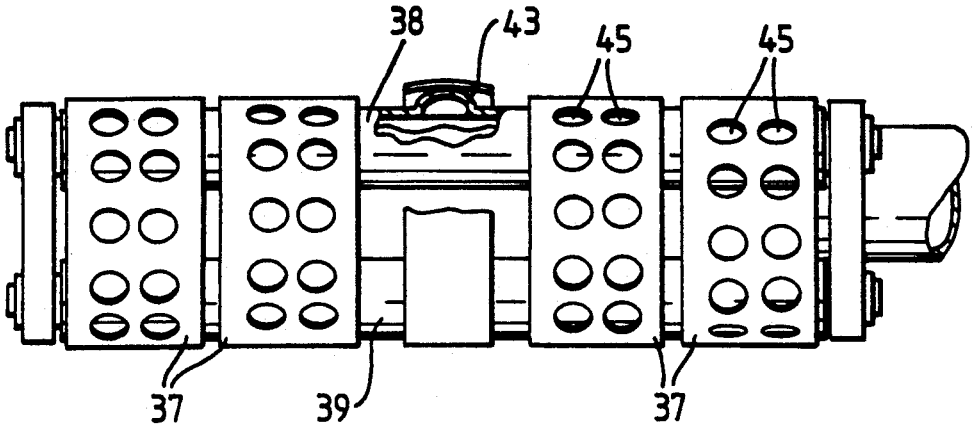
Figure 4:
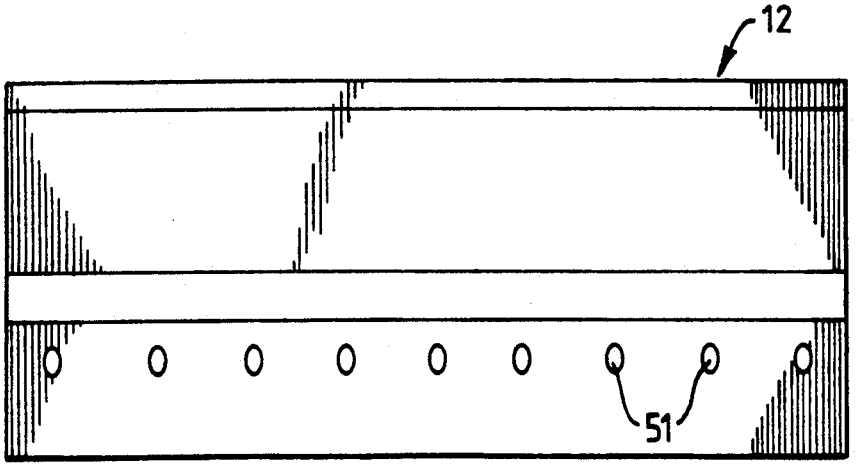
Figure 5:
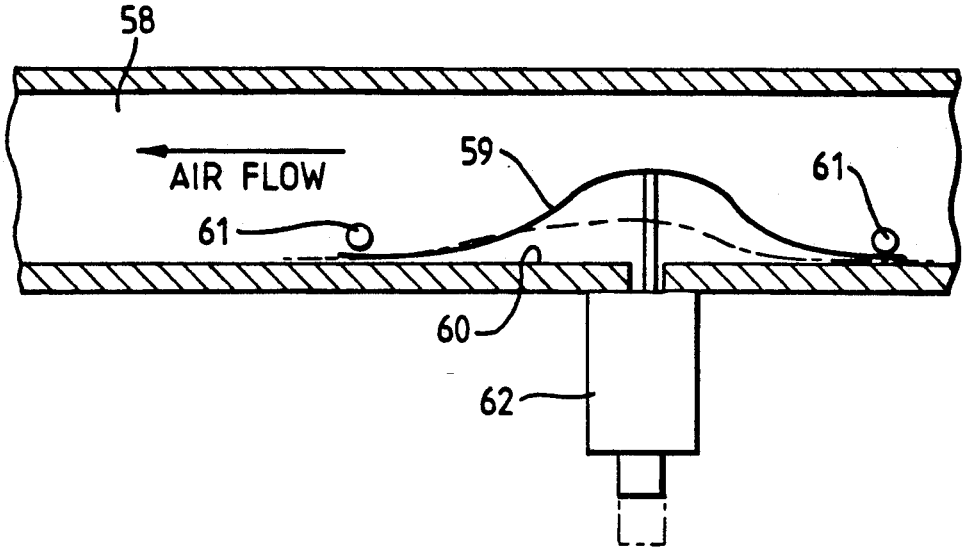
Figure 6:
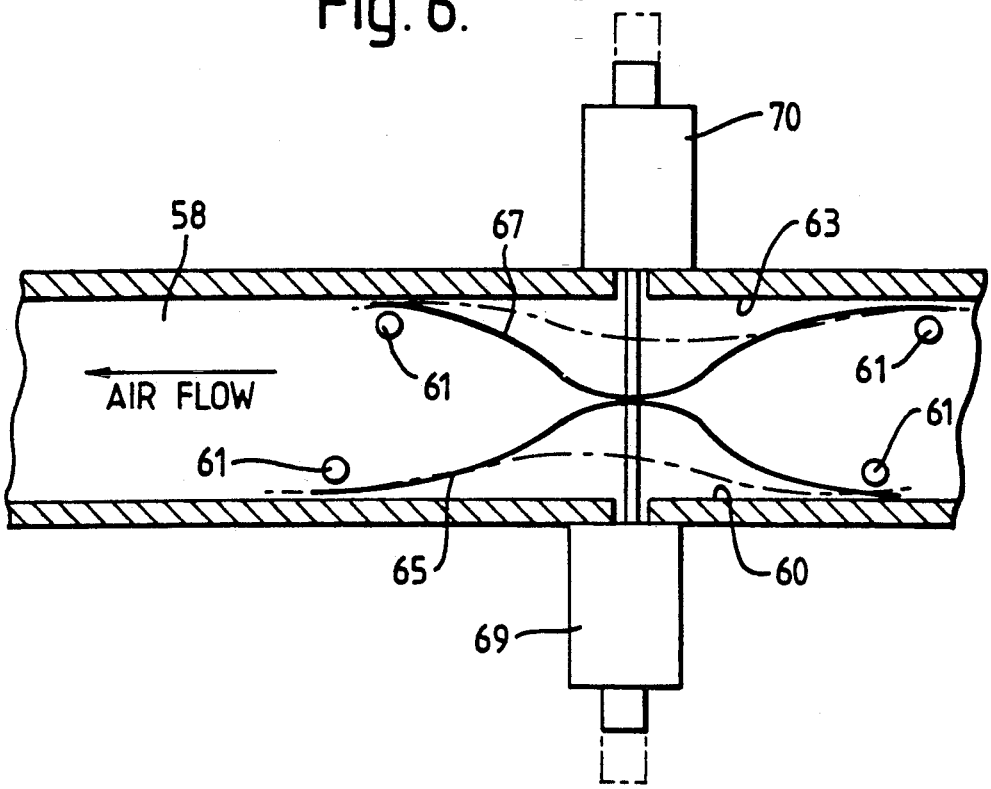

The present invention will be described further, by way of examples, with reference to the accompanying drawings in which:

FIG. 1 is a cross-sectional view of an exemplary document handler employing a sheet-feeder in accordance with one embodiment of the invention, FIG. 2 is an enlarged, cross-sectional view of the separator-feeder portion of the document handler of FIG. 1, FIG. 3 is a rear view of the document tray and feed belts of the document handler illustrated in FIG. 1, FIG. 4 is a bottom view of the air knife in the embodiment of FIG. 1, FIG. 5 is a cross-sectional view through the air knife of FIG. 1 illustrating the valve and showing different operational positions of the air flow control and FIG. 6 is a cross-sectional view through the air knife of FIG. 1 illustrating a different embodiment of valve and showing different operational positions of the air flow control.

While the application of the present invention may find use in either a document handling apparatus or a copy sheet feeder, such as a duplex tray during a duplex copying mode, for purposes of simplicity the invention will be described only with application in a document handler. The invention is particularly applicable, and will be described hereinafter, in relation to a vacuum corrugated feeder Referring to FIG. 1 of the drawings there is illustrated an automatic document handler 1 for installation above an exposure platen 3 of a xerographic reproduction machine. The document handler 1 is provided with a document tray 5 adapted for supporting a stack of documents 7 face up. A vacuum belt-corrugating feeder mechanism 9 is located below the document tray 5 for acquiring and corrugating the bottom document in the stack and forwarding the document to a take away roll pair 11 after an air knife 12 has had time to separate sheet 1 from the rest of the stack. The document is then fed by the take away roll pair 11 through a document guide 13 to a feed roll pair 15 and under a platen belt 17 onto the platen of the copy machine for reproduction. After exposure of the document, it is fed off the platen by the belt 17 into a guide 19 and feed roll pairs 21 and 23 either to an inverter mechanism 25 or back to the document stack through the feed roll pair 27.

A diverter 29 is provided to divert the document either to the inverter or to the feed roll pair 27. The inverter comprises a three roll arrangement 31 and a closed inverter pocket 33. If the document is to be inverted it is fed through the lower two rolls of the three roll inverter into the pocket. When the trail edge of the document clears the nip of the lower two rolls of the three roll inverter, the stiffness of the sheet will cause the trail edge to straighten up into the nip of the upper two rolls of the inverter at which time it will be fed into the roll pair 27 and back into the document stack.

The document handler is also provided with a set separator finger 35 as is well known in the art to separate the documents to be fed from those documents returned to the document handler.

Referring more particularly to FIGS. 2 and 3, wherein the document separator-feeder is more clearly illustrated, there is disclosed a plurality of feed belts 37 supported for movement on feed belt rolls 38,39, and 40. Spaced within the run of the belts 37, there is provided a vacuum plenum 41 having openings 43 therein adapted for cooperation with perforations 45 in the belts 37 to provide a vacuum for pulling the bottom document in the document stack onto the belts 37. In the event that more than one document is pulled down in contact with the feed belts, the beam strength of the second document resists the corrugating action, thus gaps are opened between sheets one and two which extend to their lead edges. These gaps and channels reduce the vacuum levels between sheets one and two due to the porosity in sheet one and provide for entry of the separating air flow from the air knife 12.

The air knife 12 cooperates with a pressurized air plenum 50 having a plurality of air jet openings 51 (FIG. 4) arranged to inject air into the pocket formed between the document pulled down against the feed belt and the documents thereabove. Nine air jet openings 51 are shown in FIG. 4 but typically it is sufficient to provide just six holes restricted to the center extending one third of the sheet width. This arrangement provides an air cushion or bearing between the stack and the bottom document to minimize the force necessary for removing the bottom document from the stack, and to reduce the chance of pulling other documents from the stack. It can be understood that if two documents are pulled down toward the belts 37, since the top sheet would not be corrugated, the air knife would inject air into the space between the two documents and force the second document off from the acquired document and back toward the document stack.

By reference to FIGS. 1, 2, and 3, it can be seen that the document tray 5 is provided with a depressed portion or pocket 53 behind the feed belt assembly. The pocket 53 serves a number of purposes. Firstly, space is provided for the forward portion of the bottom document to be pulled down onto the feed belt assembly. When the bottom document is pulled into this space and corrugated, an envelope type opening or pocket is created between the bottom sheet and the remainder of the sheets in the stack. Air injected into this space from the air knife produces an air bearing between the bottom sheet and the remainder of the stack to allow easy removal of the bottom sheet from beneath the stack. Flow of air from the pocket is restricted by the partial seal or flow restriction caused by supporting the major portion of the stack weight on the edge portions of the tray surrounding the pocket.

By reference to FIG. 1, it can be seen that a blower unit 55 is utilized to provide sub-atmospheric pressure in the plenum 41 and pressurized air to the air knife 12. A valve 57 is provided in the outlet line from the blower 55. The blower 55 may, for example, operate at continuous speed and air flow while the system is controlled by various flow conditions imposed by the valve 57. At the start of the feed cycle, the valve 57 is partially closed during acquisition. Upon opening of the valve 57 the flow of air from the air knife provides the required lifting force to float the sheet stack, which settles onto the tray between feed cycles.

In an alternative mode of operation an additional valve (not shown) is used to control the pressure (vacuum or atmospheric) in the plenum 41, the valve 57 being adjusted before a run starts. The process includes (a) the additional valve switching to create a vacuum in the plenum (41) and a document is "acquired" by the vacuum (b) simultaneously the air knife (12), operating continuously, creates a gap between the first and second documents; (c) a clutch is operated to cause the perforated belts of mechanism (9) to advance, moving the first document; and (d) before the trailing edge of the first document reaches the region of the perforated belts, and after the lead edge has entered the nip of the take away rolls, the additional valve switches to release the vacuum in the plenum 41.

In order to compensate for variations in the number of documents placed in the document tray and thus assure adequate air flow from the air knife to lift large stacks of documents while at the same time, provide a reduced air flow for different amounts of documents in the tray to prevent sheet blow away, the valve 57 in FIG. 1 is devised to provide at least two levels of flow control. In the embodiments shown in FIGS. 5 and 6 the valve 57 is arranged in a rectangular air duct 58 between the blower 55 and the air knife plenum 12 with the direction of flow indicated by the arrow.

In FIG. 5 the valve 57 comprises a sheet 59 of flexible plastics material, for example a polyester based film, placed on the inner bottom face 60 of the air duct positioned between the inlet and the first jet. Small features, for example pins 61 molded to the side walls of the duct, restrain the ends of the sheet 59 from vertical movement but the sheet 59 is free to move horizontally. A 'thrust' solenoid 62 is mounted such that a plunger thereof comes through a small hole in the bottom side of the duct and bears on the center of the sheet of plastics material 59. When the solenoid 62 is energized, the plunger rises and raises the central portion of the sheet 59 thus creating a restriction in the duct. In FIG. 5 the solid line shows the solenoid 62 in its energized position and the dotted line shows the solenoid 62 in its de-energized position. The valve 57 in FIG. 5 is used, therefore, to change the flow of air from one value to another. As the function of the device is to reduce the flow of air and not to cut it off there is no requirement to seal the ends of the plastics material 59 to the face 60 of the duct but merely to restrain the ends from moving in a substantially orthogonal direction to the face 60 of the duct. The advantage of this design is simplicity and economy, as cost precision features are not required, combined with the ability to reduce air flow without inducing turbulence and noise. The reduced turbulence, and therefore reduced noise, is achieved by the smooth contour of the plastics material enabling the flow of air to expand gradually as it passes out from the valve 57.

In FIG. 6 a further embodiment of the valve is illustrated in which two sheets 65 and 67 of flexible plastics material, for example polyester based film, are placed on the bottom and top faces 60, 63, respectively, of the air duct. As in the FIG. 5 embodiment small features, such as molded pins 61, restrain the ends of the sheets 65 and 67 from vertical movement relative to the face on which they are mounted but the sheets 65 and 67 are free to move horizontally. Each of the sheets 65 and 67 is operably connected to a respective solenoid 69 and 70, the operation of each of the solenoids 69 and 70 being identical to that of solenoid 62 described in FIG. 5. The solenoids 69 and 70 can be energized simultaneously or selectively depending on the requirements of the system. As in the case of the embodiment of FIG. 5 the function of the device is to reduce air flow and not to cut it off thereby enabling the design to be manufactured simply and economically.

It will be appreciated that the constructions illustrated in FIGS. 5 and 6 can be varied and modified depending on the operational requirements of a particular air knife. For example, the lengths of the plastics material and plunger in FIG. 5 can be be such that when the solenoid 62 is energized the central portion of the plastics material is raised into contact with, or almost into contact with, the top surface of the air duct. Whereas it is convenient to arrange for the plunger to bear on the central portion of the plastics sheet the invention includes embodiments in which the plunger bears on an off-central portion of the sheet.

It is also to be understood that one or both of the fixed pins 61 can be replaced by alternative means for restraining the ends of the sheet from moving in a direction substantially orthogonal to the face of the air duct. For example, one or both of the fixed pins 61 can be replaced by rotatable pins onto which the or each end of the sheet is wound.

In an alternative embodiment the solenoid 62, or each of solenoids 69 and 70, can be replaced by one or more cam arrangements and linkages to enable the sheets of plastics material to be moved into several, or a multiplicity of positions, as opposed to just the two positions shown in FIGS. 5 and 6. In such an embodiment the valve 57 would be devised to provide a multiplicity of levels of flow control.

I claim:

1. An air injection device comprising a housing defining an air duct therein and valve means associated with said air duct for controlling the flow of air therethrough from a pressure source means, characterized in that said valve means comprises a sheet of flexible material positioned within the air duct, said sheet being non-connectedly mounted on a face of the air duct, restricting means for restricting a portion of said sheet from moving in a direction substantially orthogonal to the face while simultaneously allowing the sheet as a whole to move in a direction parallel to the face, said sheet being operably connected to control means for controlling the contour of the sheet within an air flow passing through the air duct.

2. The air injection device as claimed in claim 1, characterized by said restricting means being in the form of a plurality of projections to restrict the ends of the sheet from moving in a direction substantially orthogonal to the face, said projections defining spaces with the face to accommodate the end portions of said sheet.

3. The air injection device as claimed in claim 2, characterized in that said projections are molded to one or more walls of the air duct.

4. The air injection device as claimed in claim 3, characterized in that said sheet is positioned on an inside bottom face of the duct.

5. The air injection device as claimed in claim 4, characterized by a second sheet positioned on an inside top face of the duct opposite said first sheet.

6. The air injection device as claimed in claim 5, characterized in that each of said control means includes a respective solenoid selectively operable for moving each sheet between a pair of positions.

7. The air injection device as claimed in claim 1, characterized in that said control means is a solenoid selectively operable for moving the sheet between a pair of positions.

8. The air injection device is claimed in claim 1, characterized in that said sheet is a polyester based film.

9. A sheet separator-feeder for separating and forwarding sheets seriatim, including a stack tray adapted for supporting a stack of sheets, an air injection means adapted to provide a layer of air between the sheet to be fed and the remainder of the stack, a pressure source associated with said air injection means for providing positive air pressure to said air injection means and valve means associated with said air injection means being adapted to control the flow of air thereto from said source means, characterized in that said valve means comprises a sheet of flexible material positioned within an air duct of said air injection means, said sheet being non-connectedly mounted on a face of the air duct, means for restricting a portion of the ends of said sheet from moving in a direction substantially orthogonal to the face while simultaneously allowing the sheet as a whole to move in a direction parallel to the face, said sheet being operably connected to control means for controlling the contour of said sheet within an air flow passing through the air duct.

10. The sheet separator-feeder of claim 9, wherein said sheet is a polyester based film.

11. The sheet separator-feeder of claim 9, including a flexible material mounted on another face of the duct of said air injection means in order to control the flow of air from said source means.

* * * * *